United States Patent [19]

Kuroda et al.

[11] 4,275,563

[45] Jun. 30, 1981

[54] POWER-GENERATING PLANT HAVING INCREASED CIRCULATING FORCE OF WORKING FLUID

[75] Inventors: Michio Kuroda, Hitachi; Shozo Nakamura, Hitachiouta; Satoshi Tsukahara, Hitachi; Yasuaki Akatu, Hitachi; Shigehisa Sugita, Hitachi; Kojiro Kaneko, Hitachi; Seiichiro Sakaguchi, Hitachi; Ryoichiro Oshima, Hitachi, all of Japan

[73] Assignee: Hitachi, Ltd., Tokyo, Japan

[21] Appl. No.: 4,577

[22] Filed: Jan. 18, 1979

[30] Foreign Application Priority Data

Feb. 3, 1978 [JP] Japan ..... 53-10502

[51] Int. Cl.[3] ..... F01K 25/06

[52] U.S. Cl. ..... 60/673; 60/649; 122/31 R; 165/111

[58] Field of Search ..... 60/641, 649, 673, 651, 60/671, 670; 122/31 R; 165/111; 261/18 R, 141

[56] References Cited

U.S. PATENT DOCUMENTS

| | | | |
|---|---|---|---|
| 1,658,910 | 2/1928 | Trumble | 60/673 X |
| 2,868,523 | 1/1959 | Cundiff et al. | 122/31 R |
| 4,084,379 | 4/1978 | Schwartzman | 60/649 X |
| 4,122,680 | 10/1978 | Isshiki et al. | 60/649 |

*Primary Examiner*—Allen M. Ostrager
*Assistant Examiner*—Stephen F. Husar
*Attorney, Agent, or Firm*—Craig and Antonelli

[57] ABSTRACT

A power generating plant which includes a direct contact-type heat exchanger. A low-boiling point medium such as freon and a heat-source medium such as heated oil, are injected from a lower portion of the heat exchanger so that the two media are brought into direct contact with each other thereby vaporizing the gaseous low-boiling point medium. The low-boiling medium acts as a working fluid while it circulates through a closed cycle of the plant which includes a turbine and a condenser. The heat-source medium, circulates in a closed cycle of the plant which includes a heating unit.

16 Claims, 2 Drawing Figures

POWER-GENERATING PLANT HAVING INCREASED CIRCULATING FORCE OF WORKING FLUID

BACKGROUND OF THE INVENTION

The present invention relates to a power-generating plant which utilizes, as a working fluid, a gaseous low-boiling point medium produced by the direct contact of the low-boiling point medium with a heat-source medium. More specifically, the invention relates to a power-generating plant in which the circulating force of the working fluid is increased.

A power-generating plant consists chiefly of an evaporator unit for producing a working fluid, a turbine unit for converting the thermal energy of the gaseous working fluid produced in the evaporator unit into an electric energy, and a condenser unit for liquefying the working fluid which has done the work in the turbine. The working fluid circulates in a closed cycle formed by connecting the above-noted units.

In recent years, a low-boiling point medium has been widely used as a working fluid for power-generating plant in order to efficiently utilize natural resources. For example, a low-boiling point medium such as freon, butane, ammonia or the like is used as a working fluid, and is vaporized by exchanging the heat with a heat-source mdium which is heated, such as hindered ester oil, turbine oil, alkylbenzene oil or the like. Usually, however, these low-boiling point media have small heat conductivity presenting great thermal resistance at the time of vaporization. Therefore, when the heat is to be exchanged by bringing the low-boiling medium into indirect contact with the heat-source medium, the areas for conducting the heat must be increased. This causes the heat exchangers to become bulky which is economically disadvantageous from the standpoint of the whole power generating plant. It is therefore required to reduce the size of the heat exchangers.

A heat exchanger of the direct contact type for heating a low-boiling point medium that serves as a working fluid has been proposed in, for example, Japanese Patent Laid-Open No. 52-118146 filed in 1976, wherein the point medium is brought into direct contact with a heat-source medium. According to this publication, either one of the low-boiling point medium or the heat-source medium is introduced into a lower portion of the heat exchanger, and the other liquid is introduced into an upper portion of the heat exchanger, such that the two liquids will flow in the opposite directions in the heat exchanger. However, when the two liquids are caused to flow in the opposite directions in the heat exchanger as proposed in this publication, the two liquids collide whereby a circulating force of the heat-source medium is weakened in the heat exchanger and in the closed cycle including the heat exchanger. Consequently, the heat exchanger cannot sufficiently increase its heat-exchanging performance, and the turbine cannot increase its operation efficiency. Further, in order to increase the circulating force of the heat-source medium, a pump, installed in the closed cycle of heat-source medium, must have increased capacity.

SUMMARY OF THE INVENTION

The object of the present invention is to provide a power-generating plant equipped with a direct contact-type heat exchanger, which exhibits increased heat-exchanging performance as a result of an increased circulating force of the heat-source medium in the direct contact-type heat exchanger and in the closed cycle inclusive of the heat exchanger.

The feature of the present invention resides in that a low-boiling point medium and the heat-source medium are introduced into a lower portion of the heat exchanger, such that the two liquids will flow in a direction opposite to the direction of gravity. Due to this arrangement, the circulating force of the heat-source medium is increased in the heat exchanger accompanying the rise of bubbles of the vaporized low-boiling point medium, thereby enabling the heat-exchanging performance of the heat exchanger to be increased.

DETAILED DESCRIPTION OF THE PREFERRED EMBODIMENT

Figure 1:
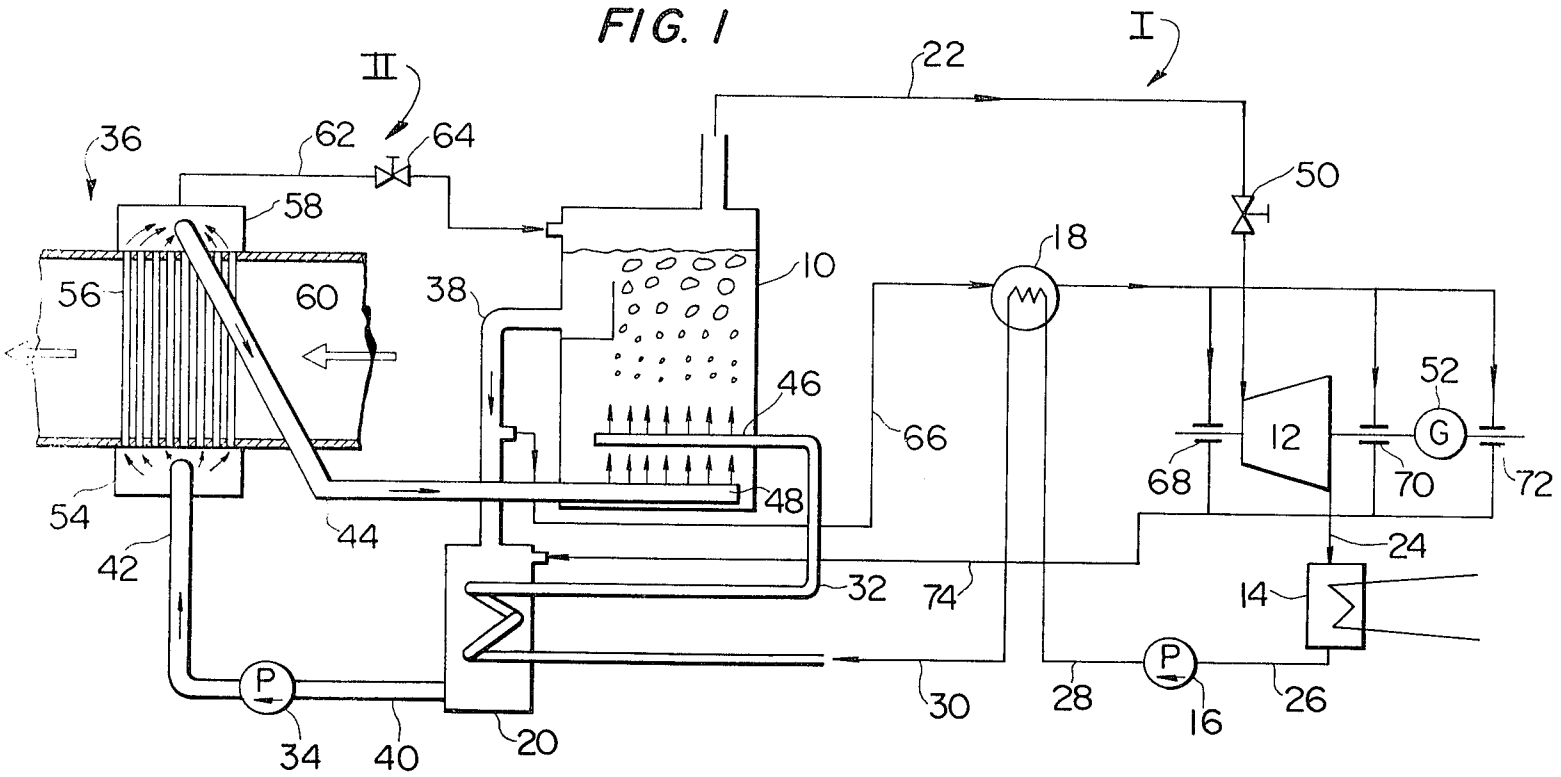
FIG. 1 is a schematic view of a system of a whole power-generating plant according to the present invention and, in particular detail, a construction of a closed cycle inclusive of a direct contact-type heat exchanger in which the low-boiling point medium will be brought into direct contact with the heat-source medium.

An embodiment of the invention is illustrated below with reference to FIG. 1, in which the freon is used as a low-boiling point medium and an oil is used as a heat-source medium. The power-generating plant consists of a first circulation system defining a closed cycle generally designated by the reference numeral I in which the freon circulates and a second circulation system defining closed cycle generally designated by the reference numeral II in which the oil circulates. The first closed cycle I is chiefly made up of a direct contact-type heat exchanger 10, a turbine 12, a condenser 14, a pump 16, a lubricating oil cooler 18, an oil cooler 20, and pipes 22, 24, 26, 28, 30 and 32 for connecting them. The second closed cycle II, on the other hand, is composed of the direct contact-type heat exchanger 10, the oil cooler 20, a pump 34, an oil heater 36, and pipes 38, 40, 42 and 44 for connecting them.

Freon injection nozzles 46 and oil injection nozzles 48 are installed in a lower portion of the direct contact-type heat exchanger 10. The oil injection nozzles 48 are directed in an upward direction and are installed below the freon injection nozzles 46. Air bubbles of the freon evolved by the direct contact of the two liquids are collected in the upper portion of the heat exchanger 10 and introduced into the turbine 12 through pipe 22. Since the oil injection nozzles 48 are installed beneath the freon injection nozzles 46, the heat of the freon is efficiently exchanged due to the mixing action as it separates away from the freon injection nozzles 46, and further, the freon is prevented from accumulating on the bottom of the heat exchanger 10.

The amount of the freon gas flowing from the heat exchanger 10 to the turbine 12 is adjusted by a valve 50. The freon gas does the work in the turbine 12. The turbine 12 and an electric generator 52 driven by the turbine 12 work to convert the heat energy of the freon gas into electric energy. The freon gas coming out of the turbine 12 is condensed in the condenser 14. The condensed freon liquid is transferred by the pump 16 under pressure to the lubricating oil cooler 18. The freon liquid which has cooled the lubricating oil further cools the oil flowing from the heat exchanger 10 to the pump 34 while it flows through the oil cooler 20. The freon liquid is transferred from the oil cooler 20 to the freon injection nozzles 46 provided at the lower portion of the heat exchanger 10 to circulate in the closed cycle I.

Most of the oil which imparted the heat to the freon in the direct contact-type heat exchanger 10 goes out of the heat exchanger 10 through a port located slightly lower than the liquid level in the heat exchanger 10, and flows into the oil cooler 20 through the pipe 38. The oil injected from the oil injection nozzles 48 into the heat exchanger 10 receives the upwardly directed force produced by the rising freon bubbles in the heat exchanger 10. The upwardly directed force serves as a force for circulating the oil in the heat exchanger 10 and in the closed cycle II.

Figure 2:
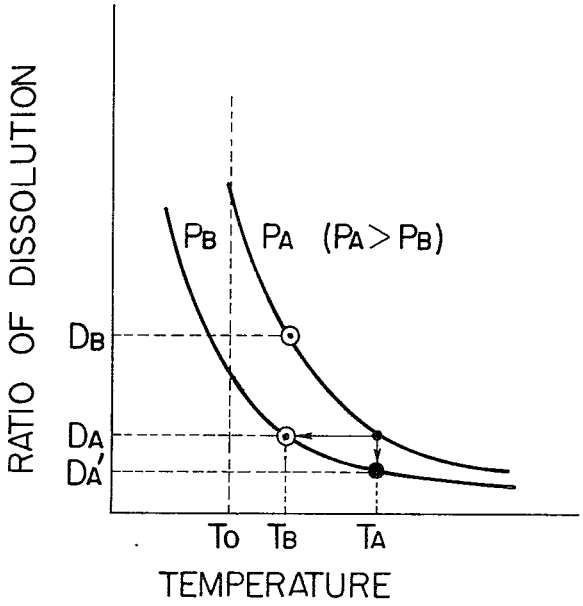
FIG. 2 is a graph showing the relationships between the fluid temperature and the ratio of dissolution, to clearly illustrate the significance of installing a heat-source medium cooling device.

The oil cooler 20 lowers the temperature of the oil coming from the direct contact-type heat exchanger 10, so that no cavitation develops in the pump 34. That is, the high-temperature oil and the low-temperature freon are brought into contact with each other in the direct contact-type heat exchanger 10. Therefore, the oil coming out of the heat exchanger 10 will contain the freon in a saturating amount under that condition. If the oil is introduced into the pump 34, the freon contained in the oil will vaporize as the pressure is lowered in the pump 34. In such a case, the circulating ability of the oil will be lost. One of the methods to eliminate such a possible loss of circulating ability of the oil resides in cooling the oil. In general, the dissolution of a low-temperature fluid in a high-temperature fluid varies depending upon the temperature as shown in FIG. 2. The low-temperature fluid most dissolves at a saturation temperature To; the ratio of dissolution decreases as the temperature increases above the saturation temperature To. Further, as the pressure is decreased from $P_A$ to $P_B$ ($P_A-P_B$), the dissolution curve shifts toward the left in the drawing; the ratio of dissolution decreases if the temperature remains the same. For instance, if the pressure of the oil coming out of the heat exchanger 10 is $P_A$ while the temperature is $T_A$, the oil will contain the freon at a dissolution ratio $D_A$. In this case, if the pressure is decreased from $P_A$ to $P_B$ with the temperature of the oil maintained constant, the ratio of dissolution becomes $D_A'$, whereby the freon is allowed to evaporate by an amount ($D_A-D_A'$). This means that the cavitation develops in the pump 34. To cope with this inconvenience, the oil cooler 20 is provided to lower the temperature of the oil flowing into the pump 34 from $T_A$ to $T_A$. In this case, the temperature is lowered to $T_B$ with the dissolution degree maintained at $D_A$. Therefore, no freon vaporizes under the pressure $P_B$. The ratio of dissolution of freon at the temperature $T_B$ and under the pressure $P_A$ is $D_B$, while the practical ratio of dissolution is $D_A$. Thus, there is a margin equivalent to ($D_B-D_A$). As mentioned above, the oil cooler 20 works to prevent the cavitation in the pump 34 as well as to recover the heat so that heat losses are minimized. According to the present invention, the oil cooler 20 is provided on account of the foregoing reasons.

The oil cooled in the oil cooler 20 is fed to the oil heater 36 under pressure by the pump 34. Due to the direct contact-type heat exchanger 10 constructed as mentioned above, the oil is circulated with an increased force in the heat exchanger 10 and in the closed cycle II. Consequently, the heat-exchanging performance in the heat exchanger 10 is increased, and the pump 34 needs be of a small capacity.

The oil, pumped by the pump 34, is heated in the oil heater 36, introduced again as the heat-source medium into the direct contact-type heat exchanger 10, and injected into the heat exchanger 10 through the oil injection nozzles 48. Referring to the oil heater 36, the oil introduced from the pipe 42 to a lower heater 54 is distributed into many heat conductor pipes 56 and collected in an upper heater 58. The heat conductor pipes 56 penetrate through a pipe 60 and are heated by a high-temperature fluid flowing therethrough. The high-temperature oil collected in the upper header 58 is fed to the lower portion of the direct contact-type heat exchanger 10 via pipe 44, and is injected into the heat exchanger 10 through the oil injection nozzles 48.

The upper header 58 of the oil heater 36 has a pipe 62 through which the freon gas contained in the oil and evolved in the oil heater 36 can be introduced into the upper portion of the direct contact-type heat exchanger 10. A valve 64 is provided at the middle portion of the pipe 62 is provided a valve for adjusting the flow rate of the freon gas depending upon the pressure differential between the oil heater 36 and the direct contact-type heat exchanger 10.

Part of the oil which has imparted the heat to the freon in the direct contact-type heat exchanger 10 is fed to the lubricating oil cooler 18 through a pipe 66 branched from the pipe 38, and heats the freon condensed in the condenser 14, whereby the oil itself is cooled. The cooled oil lubricates and cools the bearings 68, 70, 72 supporting the shafts of the turbine 12 and the electric generator 52. Thereafter, the oil is returned to the oil cooler 20 where it meets the oil in the closed cycle II.

According to the present invention in which the low-boiling point medium and the heat-source medium are injected from the lower portion of the heat exchanger 10 in which the two media are brought into direct contact with each other, it is possible to increase the force for circulating the heat-source medium utilizing the flow of the media produced by the difference in density caused by the temperature difference between the two liquids, and utilizing the flow of media produced by the buoyancy of bubbles of the low-boiling point medium evolved in the heat exchanger 10. As a result, it is allowed to increase the heat-exchanging performance in the direct contact-type heat exchanger 10, using a pump of a reduced capacity.

What is claimed is:

1. A power generating plant comprising a first circulation means for circulating a low boiling point medium in a closed cycle, a second circulation means for circulating a heat source medium in a closed cycle, heat exchanger means operatively connected with the first and second circulation means for bringing the low-boiling point medium and the heat source medium into direct contact so as to generate a working fluid, the first circulation means includes first nozzle means arranged in a lower portion of the heat exchanger means for injecting the low-boiling point medium into the heat exchanger means, the second circulation means includes further nozzle means arranged in the heat exchanger means at a position lower than the first nozzle means for injecting the heat source medium into the heat exchanger means whereby said first nozzle means and said further nozzle means increase a force for circulating the working fluid.

2. A power-generating plant according to claim 1, wherein said first nozzle means and said further nozzle means are arranged so as to extend in an upward direction so that the low boiling point medium and the heat source medium are in a direction opposite to that of gravity.

3. A power-generating plant according to one of claims 1 or 2, which includes a further heat exchanger means for cooling the heat source medium, the second circulation means further includes a means for directing a flow of heat source medium from the first mentioned heat exchanger means to the further heat exchanger means, and wherein the first circulation means further includes means for directing a flow of the low pressure medium to the further heat exchanger means whereby the heat source medium is cooled in the further heat exchanger means and the low boiling point medium is heated.

4. A power-generating plant according to claim 1, further comprising a heater means arranged in the second circulation means for heating said heat-source medium.

5. A power-generating plant according to claim 4, wherein said circulation means includes a condiut means for introducing gaseous low-boiling point medium vaporized in said heater means into the closed cycle of the first circulation means.

6. A power-generating plant according to claim 5, wherein said heater means includes an upper header, said conduit means connecting the upper header to an upper portion of said heat exchanger means.

7. A power-generating plant according to claim 6, wherein a valve means is arranged in the conduit means for adjusting a flow rate of the gaseous low boiling point medium in said conduit means into the upper portion of the heat exchanger means.

8. A power-generating plant according to one of claims 1, 2, 4, 5, or 6, wherein the second circulation means further includes a cooler means for cooling said heat source medium, means for directing a flow of the heat source medium from the heat exchanger means to the cooler means, the first circulation means further includes means for directing a flow of the low boiling point medium to the cooler means so that the low-boiling point medium returning to the heat exchanger means is used to cool the heat source medium.

9. A power-generating plant according to claim 7, characterized in that the valve means is arranged in a middle portion of said conduit means.

10. A power-generating plant according to one of claims 1, 2, 4, 5, or 6, characterized in that the low boiling point medium is selected from a group consisting of freon, butane and ammonia, and wherein the heat source medium is selected from a group consisting of hintered ester oil, turbine oil, and alkylbenzene oil.

11. A power-generating plant according to claim 1, which includes a turbine means and a generator means driven by said turbine means, and wherein the first circulation means further includes a conduit means interposed between the heat exchanger means and the turbine means for supplying a working fluid to the turbine means.

12. A power-generating plant according to claim 11, wherein the heat source medium is oil.

13. A power-generating plant according to claim 11, wherein the first and second circulation means each include a cooler means for cooling the oil, means are disposed between the heat exchanger means and the cooler means of the second circulating means for directing a flow of oil from the heat exchanger means to the cooler means, and wherein means branch off from the oil flow directing means of the second circulation means for directing a flow of oil therefrom to the cooler means of the first circulation means, means are disposed between an outlet of the turbine means and the cooler means of the first circulation means for directing a flow of the low boiling point medium to the cooler means of the first circulation means so that the low boiling point medium cools the oil flowing through said last-mentioned cooler means.

14. A power-generating plant according to claim 13, wherein means are provided for directing a supply of oil from the cooler means of the first circulation means to bearings of at least one of the turbine means and the generator means.

15. A power-generating plant according to claim 14, wherein means are provided for directing a flow of the low boiling point medium from the cooler means of the first circulation means to the cooler means of the second circulation means so that the low boiling point medium cools the oil flowing through said last-mentioned cooler means.

16. A power-generating plant according to claim 15, wherein a heater means is arranged in the second circulation means for heating the heat source medium.

* * * * *